United States Patent [19]

Battistella

[11] Patent Number: 4,907,421

[45] Date of Patent: Mar. 13, 1990

[54] AUTOMATIC PLATEFREEZER, WITH HORIZONTAL FREEZING PLATES, SUITABLE TO APPLY PRESSURE ON THE PRODUCT DURING NORMAL FREEZING OPERATIONS

[75] Inventor: Guido Battistella, Milan, Italy

[73] Assignee: Stal Samifi S.p.A., Italy

[21] Appl. No.: 223,555

[22] Filed: Jul. 25, 1988

[30] Foreign Application Priority Data

Jul. 31, 1987 [IT] Italy ..... 21546 A/87

[51] Int. Cl.[4] ..... F25C 5/14

[52] U.S. Cl. ..... 62/341; 100/93 P; 100/194

[58] Field of Search ..... 62/341; 100/93 P, 194, 100/195, 199

[56] References Cited

U.S. PATENT DOCUMENTS

| | | | |
|---|---|---|---|
| 2,927,443 | 3/1960 | Knowles | 62/341 |
| 3,236,176 | 2/1966 | Fischer | 100/195 |
| 3,271,973 | 9/1966 | Amerio et al. | 62/341 |
| 3,950,564 | 11/1974 | Hutter | 100/195 X |
| 3,998,580 | 12/1976 | Pffiffer | 100/93 P X |
| 4,240,270 | 12/1980 | McLaughlin | 62/341 |
| 4,432,214 | 2/1984 | Richelli et al. | 62/341 |
| 4,553,406 | 11/1985 | Richelli et al. | 62/341 |

*Primary Examiner*—William E. Tapolcai

*Attorney, Agent, or Firm*—Steinberg & Raskin

[57] ABSTRACT

Automatic freezer with horizontal refrigerating plates that continuously apply pressure on a product being frozen, in which a series of plates held between a bottom and a top frame linked through rods: with lifting and lowering the above plates in order to position each of them, one after the other, in correspondence with an infeed opening where the product is loaded. The above plates are caught and kept due to double supports, in a proper position corresponding to such opening while maintaining the level of the plate being loaded, even while forces are applied on the plates below it for lowering them. Such forces are applied on the plate below the one being loaded in order to transfer their action on the remaining plates below and also, through the rods, on the plates above the one being loaded, thus obtaining pressure on all product positioned between the plates.

7 Claims, 5 Drawing Sheets

AUTOMATIC PLATEFREEZER, WITH HORIZONTAL FREEZING PLATES, SUITABLE TO APPLY PRESSURE ON THE PRODUCT DURING NORMAL FREEZING OPERATIONS

BACKGROUND OF THE INVENTION

This invention is concerned with an automatic horizontal plate freezer.

Presently machines of this type are well known and commonly used in the food processing industry to freeze large quantities of packaged products having generally, flat and parallel sides.

All horizontal plate freezers ensure the heat transmission due to the "direct contact" between the cold plates and the product: i.e., the heat is transmitted by "conduction". In these plate freezers means are provided for obtaining low temperature of plates, i.e. these latter are adequately cooled by a refrigerant circulating inside them.

When product is inserted between two cold plates, and is in contact with them, a double heat transmissin occurs due to this "double contact".

In order to embody the above principle, the plate freezers are all structured in such a way that, when they operate, first the plates are "opened" (i.e. sufficiently spaced apart from each other) for the introduction of the product, through an opening, and in the subsequent step they are "closed" again (i.e. approached to the product), to accomplish the "double contact", as described above. In all horizontal plate freezers, to properly apply the "double contact", the freezing plates are provided with spacers of proper height, either fixed or adjustable, housed in "U" channels located at the side edges of the plates, so that, in their closed position, said plates will be correctly placed parallel to each other and in contact with the product without damaging it.

It is obvious that spacers of correct height are to be employed because otherwise either damage to product or inefficient heat transmission would result.

In order to understand the scope of the present invention it is necessary to consider that the food processing industry often requires large quantities of frozen product in blocks, with very tight size and weight specifications; these blocks must guarantee maximum flatness and consistency being subject to further processing such as cutting in smaller portion, e.g. fish fingers, etc. To that purpose the loose product is introduced into strong metal frames, that give shape to the blocks. The frames are then placed into the machine that performs the freezing, and that, at the same time, has to apply pressure on the open side of the frames to obtain the desired shape.

After freezing, product is removed from the frames. At present, the only horizontal plate freezer suitable for these blocks are manually loaded and unloaded: their plates are opened, product is loaded, then plates are closed again and maintained under pressure for the necessary freezing time.

Clearly, such manual handling can hardly suit large production of blocks because of the labour costs involved and of short-comings of an intermittent running.

It is necessary to point out that present automatic freezers are designed in such a way that they cannot apply pressure on product, and therefore their use is limited to packaged products (mostly consumers packages), thus leaving out the vast applications of block freezing.

SUMMARY OF THE INVENTION

The present invention is directed to an automatic plate freezer with horizontal freezing plates, wherein means are provided in which, during normal loading operation of each plate, apply pressure on all plates previously-loaded. Preferably, catch arms are provided which are equipped with double supports, in order to obtain an opening for inserting product on a plate to be loaded, while also keeping the plate to be loaded at a constant level, even if force is applied tending to lower the plate underneath the plate being loaded. The force is preferably applied on the plate below the one being loaded, so that by the action of rods, the force or pressure is transferred to all other plates above the plate being loaded. The means generating the force to press the product, do not interfere with movement of the plates themselves.

More specifically, the present invention is directed to an automatic freezer with horizontal freezing plates comprising a set of plates between an upper and lower frame, these frames being interconnected to each other by tie-rods, means for lifting and lowering the set of plates, arms for catching the plates through double supports and holding the same near a product infeed opening, so that the position of the plate being charged or loaded is fixed, even when a force is applied to plates below the same tending to lower the overall set, and means are provided for applying this force to the plate directly underneath the plate being charged, so that the force is transferred also to the other plates and, through the tie rods, to the upper plates, thus applying a pressure to the entire charged product.

This pressure applying means preferably comprise brackets mounted on a rod of a piston in turn hinged to the displaceable supports. Guides are preferably provided on the displaceable supports, to space apart the brackets when lifting the set of plates.

DESCRIPTION OF THE PREFERRED EMBODIMENTS

Figure 1:
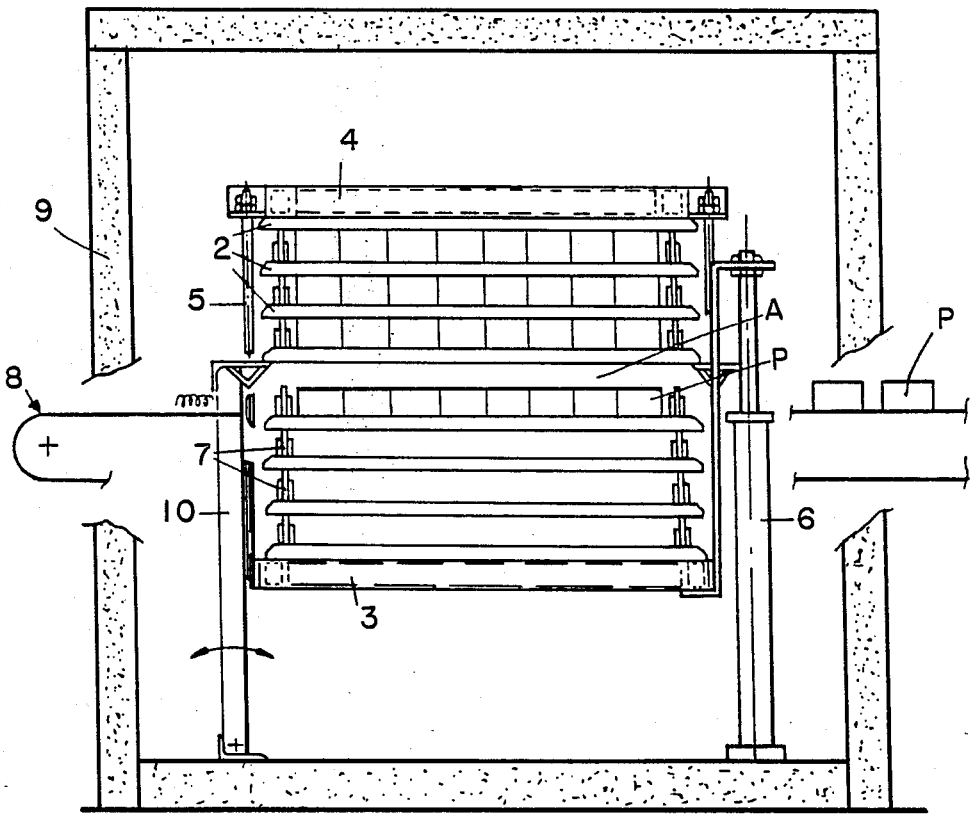
FIG. 1 is an elevational view of a prior art freezer apparatus.

The plate-freezer subject of the present invention is able to apply pressure on product during freezing and it is a continuous, in-line, automatic machine.

To understand properly the characteristics of this new freezer, it is better to refer to U.S. Pat. Nos. 3,271,973 and 3,557,975 and to FIG. 1 which is an elevation view of a type of standard freezer.

A plate stack with a plurality of plates 2, supported by a bottom frame 3, connected to a top frame 4 through adjustable rods 5, is lifted and lowered by jacks 6 acting on bottom frame 3.

Plates are spaced each other by spacers 7 of proper height in accordance with product to be frozen and fixed to the upper surface of each plate. Each plate is supported on the plate below. During running, jack 6 positions each plate 2 to the level of a feeding conveyor 8 which is in front of the freezer.

Through an inlet opening A of an insulated box 9 specific loading devices of known type (as described in U.S. Pat. No. 3,557,975), load the plate with packages to be frozen P, transferred by conveyor, while frozen packages come out through an opening B in the rear side of the freezer, where an unloading conveyor similar to 8 is placed.

During lifting, realized plate after plate, the springed catch arms 10 are opened by the inclined side edges of the plates and are then closed once the plate has passed.

After "catching" a plate, the lifting is interrupted and the jacks lower the bottom part of the plate stack till the length of rods permits it, thus creating the opening A for product loading between the caught plate and the plate below it which is at the conveyors level.

Consequently the plate stack is divided in two parts: an upper part and a bottom part.

The lifting—lowering action of jacks is repeated for all plates and when the plate stack is completely lifted, and all plates loaded means are provided for maintaining the catch arms in an open position at a certain distance from the plate stack, thus permitting its complete lowering and consequently a new cycle.

Before describing the freezer subject of this invention, consider the particular product to be frozen (i.e; blocks).

Figure 2:
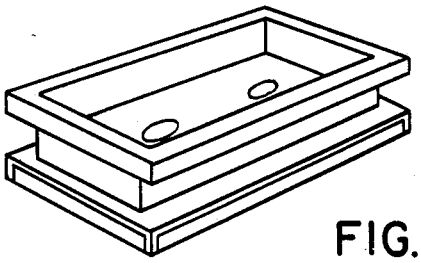
FIGS. 2–6 are view of various structure and/or product for being stored and/or frozen in accordance with the present invention.
Figure 3:
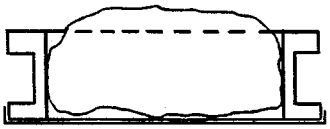
Figure 4:
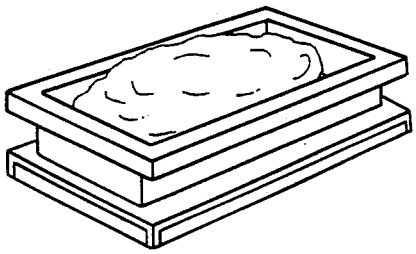
Figure 5:
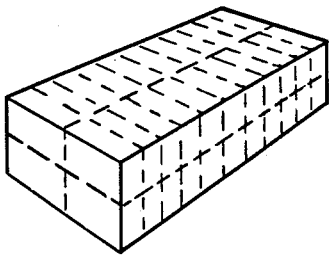

FIG. 2 represents a frame of the type used in these operations;

FIG. 3 and 4 represent the product before the introduction into the freezer;

FIG. 5 shows a frozen block; and

Figure 6:
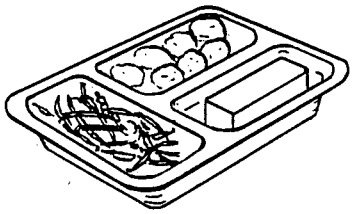

FIG. 6 shows an example of utilization in consumer food, e.g. with product surrounded by side courses.

In FIG. 3 and 4 an irregular filling of the frame as usually happens and a product higher than the frame itself can be noted.

Figure 7:
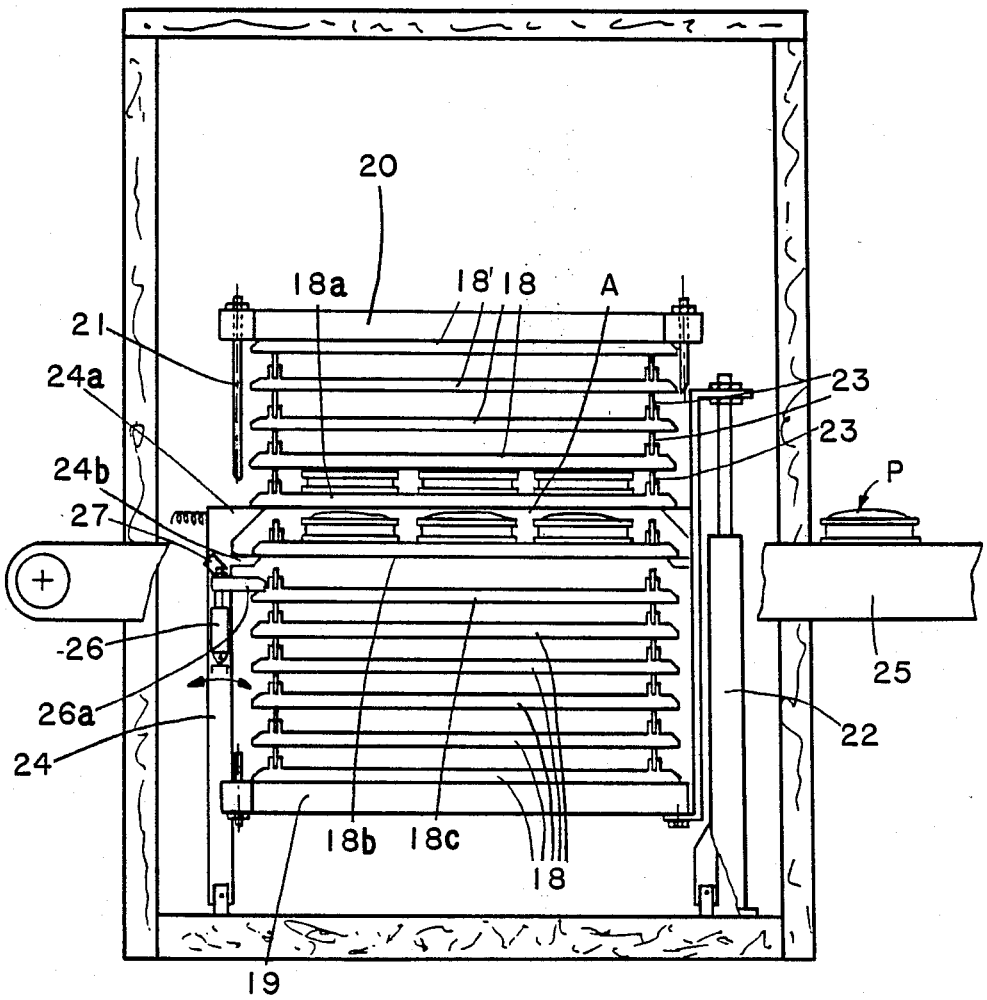
FIG. 7 is an elevational view of automatic plate freezer apparatus in accordance with the present invention.
Figure 8:
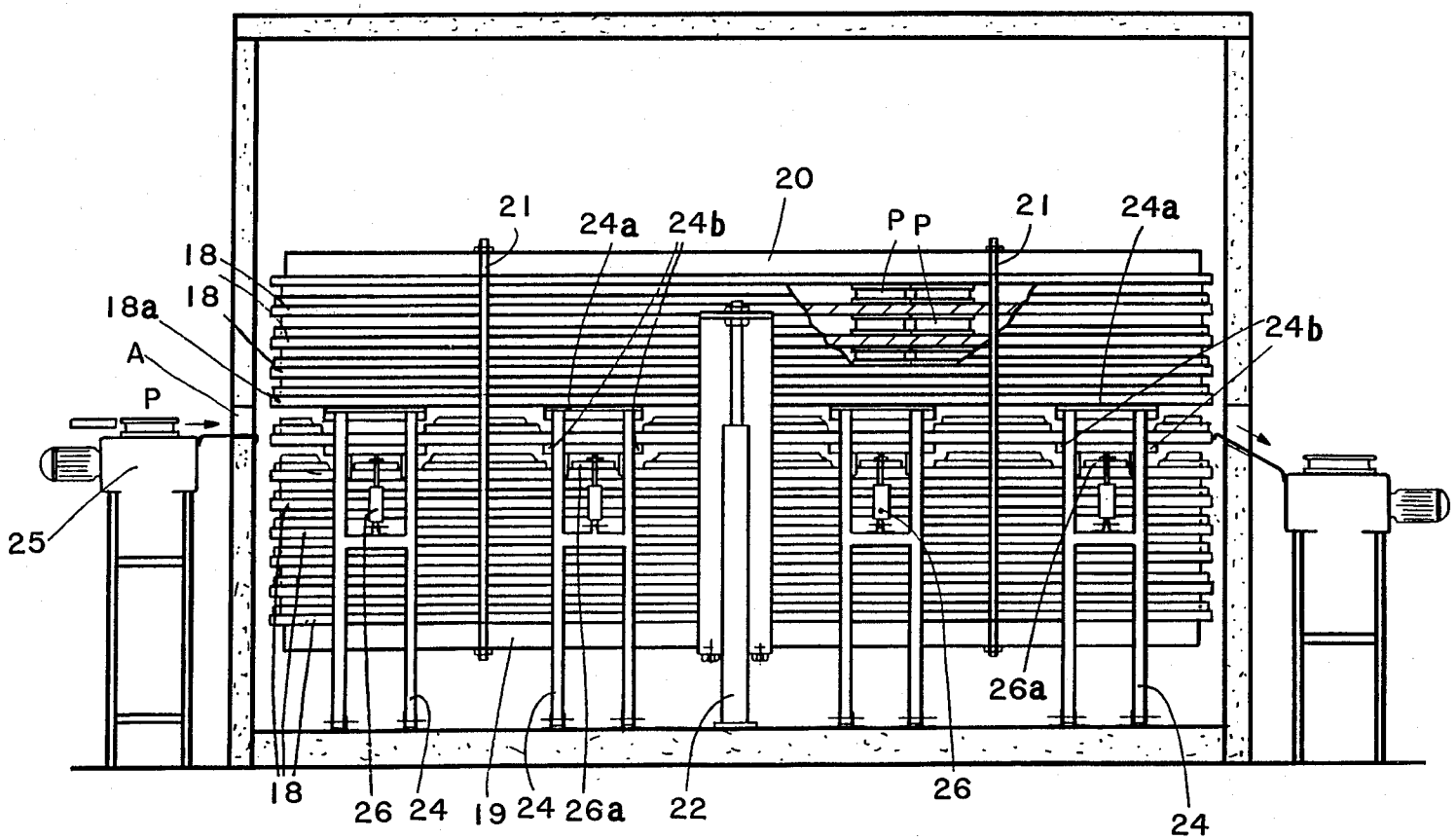
FIG. 8 is a side view of the apparatus of FIG. 7.

The freezer works in the way illustrated in FIG. 7 and 8.

The plates movement is similar to the one of plate freezer described in FIG. 1.

A plate stack with a plurality of plates 18, supported by a bottom frame 19, connected to a top frame 20 through the rods 21, is lifted and lowered by jacks 22 acting on bottom frame 19.

Plates are spaced from each other by spacers 23 fixed to the upper surface of each plate and in these applications the height of spacers is equal to the height of frames.

During lifting, that is realized plate after plate, springed catch arms 24, together with their supports **24*a* and 24*b***, open because the side edges of the plates are inclined and close again after a plate has passed.

At this stage, the lifting is interrupted and the jacks lower the bottom part of plate stack till length of rods permits it. As a result the caught plate **18*a* and all the plates over it rest on supports 24*a*, the plate 18*b* rests on supports 24*b* corresponding to conveyor level 25, and the plate 18*c* together with the remaining plates rests on bottom frame 19**.

The plate stack is consequently divided in three parts: the distance between supports **24*a* and supports 24*b* is adjusted in order to permit the introduction of the overfilled frames as shown in FIG. 3 and the distance between the plate 18*b* and the plate 18*c* is adjusted through rods 21**.

In this position frames containing the product are loaded on plate **18*b***, utilizing loading devices of known type as described in U.S. Pat. No. 3,557,975.

It is possible to note that the level of the plate to be loaded is independent from the position of the plates below it, while in FIG. 1 it was strictly dependent, being actually laid on it.

The catch arms of this plate freezer are equipped with hydraulic cylinders 26 pivoted on their base and whose rods are provided with brackets **26*a***.

During plates lifting and lowering the brackets **26*a* do not interfere with plates movement because the guides 27** keep them at a certain distance from the plate stack.

Figure 9:
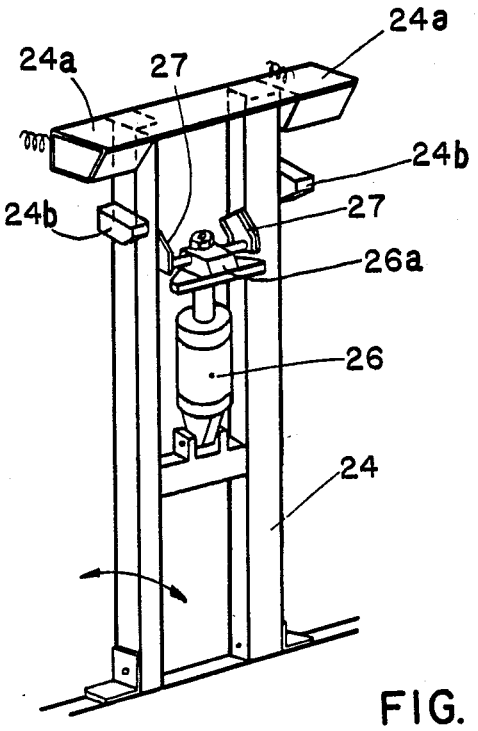
FIGS. 9–11 are views illustrating means for providing pressure onto the overall set of plates in the freezing apparatus, and for removing pressure from the plates when the overall stack is being adjusted.
Figure 10:
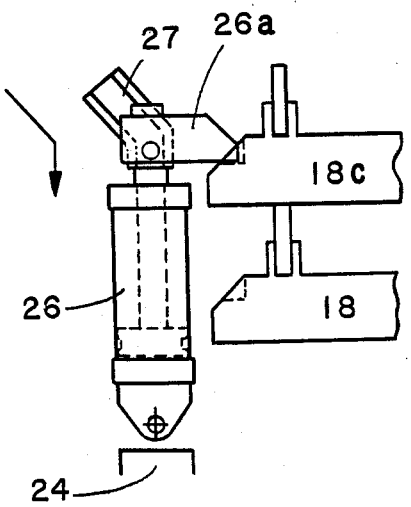
Figure 11:
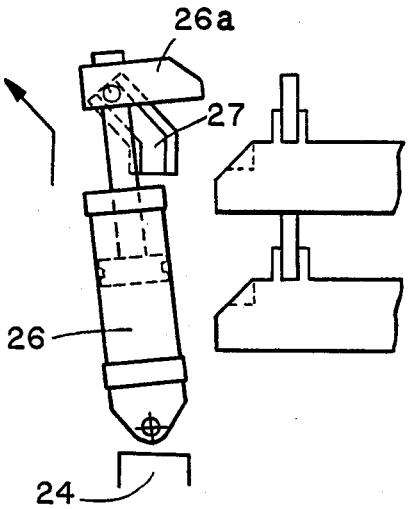

Means are provided to control the various sequences of plates and brackets movements (FIGS. 9–11).

During lifting and lowering of each plate the brackets **26*a* are in position as per FIG. 11**.

After plates lowering, when the plates are stopped, the brackets are in position as per FIG. 10 and apply the force deriving from hydraulic pressure inside the cylinders on the edges of plate **18*c*. This action on plate 18*c* results in a pressure on all plates below it, till the bottom frame 19**.

The same action is transmitted to the upper part of plates stack till the plate **18*a*, through the rods 21**.

The action of forces is only shortly interrupted during the plates movement because in these phases the brackets **26*a***, as earlier noted, are kept at a certain distance from the plate stack; however, considering that usually the time for changing a plate (a few seconds), as well as the time for complete lowering (one minute) are negligible in respect of total freezing time (a few hours), the action of above forces can be considered continuous.

During normal running of the freezer all plates are pushed down, and consequently the product into the frames is compressed. For this reason the air contained into the frame is expelled and the product is given the required squared block shape.

Product remains under pressure for all the time necessary for loading all plates or more if so desired, till in the new cycle it is again in position **18*c*, frozen and hardened, ready to be replaced in position 18*b*** by new fresh product.

The forces demanded by these applications are very high, because the proper pressure on product must be about 0.5 kg/cmq, therefore adequate strength must be guaranteed in all parts involved, particularly in plates.

All these features make the automatic plate freezer subject of this invention an entirely new machine, capable of freezing and compressing product in blocks.

It should be noted that this new machine can be also set to operate traditionally, i.e. without pressure on plates, when normal packages or cartons are handled, while normal automatic plate freezers so far employed for packages or cartons, can not attain the result of applying on plates the pressure required for freezing blocks.

I claim:

1. Automatic plate freezer with substantially horizontal freezing plates, comprising means for applying pressure during loading of each plate, on all plates previously loaded, said means comprising at least one catch arm provided with double supports positioned to ensure an opening between plates for loading upon a plate being loaded while also maintaining the plate being loaded at a substantially constant level, wherein said means additionally apply pressure upon any plate situated underneath the plate being loaded while the same is being loaded, and wherein said means additionally comprise at least one rod positioned to transfer the pressure applied on the underneath plate to any plate situated above the plate being loaded.

2. The combination of claim 1, wherein said means additionally comprise an upper frame and a lower frame interconnected by said at least one rod and with the plates disposed therebetween, and means for lifting and lowering said plates.

3. The combination of claim 1, additionally comprising a plurality of said rods.

4. The combination of claim 2, additionally comprising a plurality of said rods.

5. The combination of claim 2, wherein said lifting means comprise a jack arranged to act on said lower frame.

6. Automatic plate freezer with substantially horizontal freezing plates, comprising means for applying pressure during loading of each plate, on all plates previously loaded, said means comprising at least one catch arm provided with double supports positioned to ensure an opening between plates for loading upon a plate being loaded while also maintaining the plate being loaded at a substantially constant level, wherein said means additionally comprise an upper frame and a lower frame interconnected by at least one rod and with the plates disposed therebetween, means for lifting and lowering said plates, and wherein said pressure applying means additionally comprise a piston and rod arrangement hinged to said at least one arm, and a bracket mounted upon said piston rod.

7. The combination of claim 6, additionally comprising a guide mounted upon said at least one arm to space said bracket away from the plates, when the same are being lifted or lowered.

* * * * *